US008533869B1

(12) United States Patent
Capuano

(10) Patent No.: US 8,533,869 B1
(45) Date of Patent: Sep. 17, 2013

(54) ENERGY ABSORBING HELMET UNDERWEAR

(75) Inventor: Sonya Abdow Capuano, Bristol, RI (US)

(73) Assignee: Noggin Group LLC, Port Washington, NY (US)

( * ) Notice: Subject to any disclaimer, the term of this patent is extended or adjusted under 35 U.S.C. 154(b) by 1457 days.

(21) Appl. No.: 12/033,293

(22) Filed: Feb. 19, 2008

(51) Int. Cl.
*A42B 1/04* (2006.01)
*A42B 3/06* (2006.01)

(52) U.S. Cl.
USPC ..... 2/411; 2/171

(58) Field of Classification Search
USPC ..... 2/410, 4, 5, 6.1, 7, 411, 413, 414, 2/421, 63, 68, 181, 174, 202, 267, DIG. 10, 2/171, 6.2
See application file for complete search history.

(56) References Cited

U.S. PATENT DOCUMENTS 1,479,670 A * 1/1924 McKnight ..... 2/181
1,703,848 A * 2/1929 Tuggy ..... 2/63
1,907,709 A * 5/1933 Barrow ..... 2/171
2,052,123 A * 8/1936 Adamson ..... 2/171.04
3,171,133 A * 3/1965 Steffen ..... 2/414
3,205,508 A * 9/1965 Cox ..... 2/410
3,320,682 A * 5/1967 Sliman ..... 34/95
3,366,971 A * 2/1968 Scherz ..... 2/412
3,403,406 A * 10/1968 Weissberg ..... 2/68
3,556,115 A * 1/1971 Benson ..... 132/274
3,577,562 A * 5/1971 Holt ..... 2/414
3,609,764 A * 10/1971 Morgan ..... 2/414
3,784,984 A 1/1974 Aileo
3,806,950 A * 4/1974 Spencer-Foote ..... 2/413
3,866,243 A * 2/1975 Morgan ..... 2/418
4,067,063 A * 1/1978 Ettinger ..... 2/413
4,412,358 A * 11/1983 Lavender ..... 2/412
4,432,099 A * 2/1984 Grick et al. ..... 2/412
4,575,871 A * 3/1986 Auerbach et al. ..... 2/6.6
4,581,773 A 4/1986 Cunnane
4,619,003 A * 10/1986 Asbury ..... 2/5
D287,902 S 1/1987 Forsyth
4,777,739 A 10/1988 Hiles
4,809,690 A * 3/1989 Bouyssi et al. ..... 602/74
4,929,492 A 5/1990 Carey, Jr. et al.
4,932,076 A * 6/1990 Giorgio et al. ..... 2/5

(Continued)

OTHER PUBLICATIONS

Janicak, Christopher Allen, "An Examination of Occupational Fatalities Involving Impact-Related Head Injuries in the Construction Industry," Journal of Occupational and Environmental Medicine, vol. 40(4), Apr. 1998, pp. 347-350.

(Continued)

*Primary Examiner* — Alissa L Hoey
(74) *Attorney, Agent, or Firm* — Salter & Michaelson

(57) ABSTRACT

Secondary energy absorbing helmet underwear is to be worn by a user under a primary rigid hard hat, sports helmet or military helmet. The helmet underwear includes an integral self elasticized stretchable material that includes a three-dimensional structure that is generally of semi-spherical shape to fit about the users head and that includes an optional peripheral stretchable stretch band that provides a means for retaining the helmet underwear in place on the users head. The stretchable material and core includes front and rear layers that are each formed as a knitted layer and interconnecting yarns that interconnect between the front and rear layers and define a predetermined spacing between the front and rear layers. The interconnecting yarns, in combination with the layers provide a safety barrier between the rigid hat and the user's head.

2 Claims, 13 Drawing Sheets

(56) References Cited

U.S. PATENT DOCUMENTS

| | | | | | |
|---|---|---|---|---|---|
| 4,949,404 | A | | 8/1990 | Fekete, Sr. | |
| 4,992,327 | A | | 2/1991 | Donovan et al. | |
| 5,056,162 | A | * | 10/1991 | Tirums | 2/412 |
| 5,095,545 | A | * | 3/1992 | Lane | 2/68 |
| 5,238,733 | A | | 8/1993 | Joseph et al. | |
| 5,259,071 | A | * | 11/1993 | Scott et al. | 2/413 |
| 5,316,837 | A | | 5/1994 | Cohen | |
| 5,337,420 | A | * | 8/1994 | Haysom et al. | 2/410 |
| 5,461,730 | A | | 10/1995 | Carrington | |
| RE35,193 | E | | 4/1996 | Shifrin | |
| 5,544,367 | A | | 8/1996 | March, II | |
| 5,630,230 | A | * | 5/1997 | Fujino et al. | 2/200.1 |
| 5,661,854 | A | * | 9/1997 | March, II | 2/410 |
| 5,675,844 | A | * | 10/1997 | Guyton et al. | 2/455 |
| 5,729,830 | A | * | 3/1998 | Luhtala | 2/2.5 |
| 5,778,455 | A | * | 7/1998 | Joseph | 2/209 |
| 5,850,636 | A | * | 12/1998 | Reuven | 2/174 |
| 5,887,285 | A | * | 3/1999 | McCormick | 2/181.4 |
| 5,913,412 | A | * | 6/1999 | Huber et al. | 2/414 |
| 5,930,841 | A | | 8/1999 | Lampe et al. | |
| 5,946,734 | A | | 9/1999 | Vogan | |
| 5,956,777 | A | * | 9/1999 | Popovich | 2/424 |
| 5,963,989 | A | | 10/1999 | Robertson | |
| 6,000,062 | A | | 12/1999 | Trakh | |
| 6,098,209 | A | * | 8/2000 | Bainbridge et al. | 2/456 |
| 6,103,641 | A | | 8/2000 | Gehring, Jr. | |
| 6,112,332 | A | * | 9/2000 | McCormick | 2/181 |
| 6,240,570 | B1 | * | 6/2001 | Wu | 2/410 |
| 6,247,181 | B1 | | 6/2001 | Hirsch et al. | |
| 6,360,376 | B1 | | 3/2002 | Carrington | |
| 6,397,399 | B1 | | 6/2002 | Lampe et al. | |
| 6,438,761 | B1 | | 8/2002 | McGarrity | |
| 6,519,780 | B2 | * | 2/2003 | Goodwin | 2/267 |
| 6,625,817 | B2 | * | 9/2003 | Wasmuth | 2/174 |
| 6,625,820 | B1 | | 9/2003 | Lampe | |
| 6,658,671 | B1 | * | 12/2003 | Von Holst et al. | 2/412 |
| 6,986,169 | B2 | | 1/2006 | Nakamura | |
| 7,028,344 | B2 | * | 4/2006 | Toth | 2/413 |
| 7,043,761 | B2 | | 5/2006 | Epling | |
| 7,055,179 | B2 | * | 6/2006 | Warner et al. | 2/207 |
| 7,096,512 | B2 | | 8/2006 | Blair | |
| 7,269,860 | B2 | | 9/2007 | Dennis et al. | |
| 7,676,854 | B2 | * | 3/2010 | Berger et al. | 2/410 |
| 7,895,672 | B2 | * | 3/2011 | Grey | 2/204 |
| 7,926,124 | B2 | * | 4/2011 | Hunter et al. | 2/267 |
| 7,930,768 | B1 | * | 4/2011 | Tyler | 2/209.11 |
| 8,001,624 | B1 | * | 8/2011 | Leedom | 2/425 |
| 8,082,599 | B2 | * | 12/2011 | Sajic | 2/411 |
| 8,104,593 | B2 | * | 1/2012 | Lin | 188/372 |
| 8,128,165 | B2 | * | 3/2012 | Marsden et al. | 297/216.11 |
| 8,272,073 | B2 | * | 9/2012 | Arensdorf et al. | 2/267 |
| 8,347,419 | B1 | * | 1/2013 | Cleva | 2/410 |
| 2002/0002730 | A1 | * | 1/2002 | Dennis et al. | 2/411 |
| 2002/0152542 | A1 | * | 10/2002 | Dennis et al. | 2/414 |
| 2003/0204895 | A1 | * | 11/2003 | Grilliot et al. | 2/202 |
| 2004/0107482 | A1 | * | 6/2004 | Picotte | 2/411 |
| 2004/0163162 | A1 | * | 8/2004 | Benziger | 2/411 |
| 2004/0250340 | A1 | * | 12/2004 | Piper et al. | 2/411 |
| 2005/0034215 | A1 | * | 2/2005 | Harrison et al. | 2/207 |
| 2006/0048264 | A1 | * | 3/2006 | Morency | 2/69 |
| 2006/0059605 | A1 | * | 3/2006 | Ferrara | 2/410 |
| 2006/0070170 | A1 | * | 4/2006 | Copeland et al. | 2/411 |
| 2006/0070171 | A1 | * | 4/2006 | Copeland et al. | 2/455 |
| 2006/0272071 | A1 | | 12/2006 | Mickle | |
| 2006/0288468 | A1 | * | 12/2006 | Jorgenson | 2/205 |
| 2007/0021034 | A2 | | 1/2007 | Barbour et al. | |
| 2007/0157370 | A1 | * | 7/2007 | Joubert Des Ouches | 2/410 |
| 2008/0010721 | A1 | * | 1/2008 | Campbell et al. | 2/181.4 |
| 2010/0083423 | A1 | * | 4/2010 | Erickson et al. | 2/411 |
| 2010/0107317 | A1 | * | 5/2010 | Wang | 2/411 |
| 2011/0296593 | A1 | * | 12/2011 | Dhillon | 2/410 |
| 2011/0307997 | A1 | * | 12/2011 | Blair | 2/414 |
| 2012/0060251 | A1 | * | 3/2012 | Schimpf | 2/5 |

OTHER PUBLICATIONS

Schwarz, Alan, "Some Used Football Helmets Under Scrutiny," New York Times, Dec. 12, 2007.

* cited by examiner

ENERGY ABSORBING HELMET UNDERWEAR

TECHNICAL FIELD

The present invention relates in general to secondary energy absorbing helmet underwear that is both fashionable and functional. More particularly, the present invention relates to energy absorbing helmet underwear meant for wearing under a primary rigid hat structure such as a helmet or hard hat.

DESCRIPTION OF PRIOR ART

The prior art teaches several apparatus that address the issue of athletes that engage in activities for providing protection on their heads. The prior art offers several different solutions. Examples are found in the following patents.

The U.S. Patent to Robertson (U.S. Pat. No. 5,963,989) discloses a headband to be worn on the head of a soccer player, including a padded portion adapted to ride on that area of the head normally used to head a soccer ball.

The U.S. Patent to McGarrity (U.S. Pat. No. 6,438,761) discloses an improved head guard to be worn by soccer players that protects the forehead during the act of heading the soccer ball without compromising the integrity of the game.

The U.S. Patent to Hirsch (U.S. Pat. No. 6,247,181) discloses a device designed to reduce head injuries among soccer players and others who would not otherwise wear head protection.

The U.S. Patents to Lampe (U.S. Pat. Nos. 6,625,820; 6,397,399 and 5,930,841) disclose head guards comprising of a front panel, a rear panel and a means for releasably connecting the lateral ends of the front and rear panels.

The U.S. Patent to Trakh (U.S. Pat. No. 6,000,062) discloses an improved head protection structure for soccer players and is especially directed to improved protective headbands.

Other prior art discloses head structures or flexible helmets that are the primary means themselves for the protection of a user's head. The following are examples.

U.S. Patent by Aileo (U.S. Pat. No. 3,784,984) discloses a flexible helmet having plural inner and outer panels of woven fabric cut and assembled so as to conform closely to the heads of different shapes and sizes and plural pads for protecting the wearers' head against impacts.

U.S. Patent by March (U.S. Pat. No. 5,544,367) discloses an aerodynamically streamline flexible protective helmet assembly.

Other prior art has sought to provide head protective apparatus that is the primary means of protecting the head for athletes such as basketball and soccer players that engage in activities without any protection of their heads. The following is an example.

U.S. Patent Vogan (U.S. Pat. No. 5,946,734) discloses a ¾" thick head protector having a plurality of rupturable close cell, fluid cells, each having a rupturable common wall, with a low pressure, empty cell between first and second liners and with optional cloth inner and outer liners.

Other prior art has focused on the hair management of the wearer such as found in U.S. Patent Warner (U.S. Pat. No. 7,055,179) which discloses a type head covering and more particular relates to a type of helmet underwear having an integrated elasticized sweatband that is designed to fit snugly on the wearer's head and to protect the wearer's hair, especially during athletic activity.

Still other prior art is concerned with thermal comfort or insulation for keeping a person's head warm and for retaining warmth of the sinus, ears, neck, back and sides of the head. Examples are found in the following patents.

U.S. Patent Epling (U.S. Pat. No. 7,043,761) discloses a removable liner headgear. The liner is specifically configured for placement within a cap member, hat or any sort of helmet underwear for enhanced thermal comfort.

The U.S. Patent Fekete (U.S. Pat. No. 4,949,404) discloses of a hard hat liner for wearing beneath a hard hat and for retaining warmth of the sinus and ears and neck, back and sides while concurrently being fashioned to avoid blocking good view/visibility and being fashioned to avoid blocking of hearing of warning sounds.

Other prior art includes Gehring (U.S. Pat. No. 6,103,641) which discloses a fabric used for blunt trauma reduction in body armor. This type of prior art would not be anticipated as for use as helmet underwear.

All of the above patent are hereby incorporated by reference in their entirety.

BACKGROUND OF THE INVENTION

Athletes, construction workers, soldiers and others enjoy society's penchant for establishing one's own identity by looking and appearing "fashionably cool" by wearing doo rags, skull caps and bandanas. Often the sole function of this type of helmet underwear is for appearance or to keep one's hair organized during an activity. Very often, for example, construction workers will don a mandatory or functional protective helmet or hard hat and continue to wear the non-functional fashionable helmet underwear beneath it.

Much attention has been given to the research and development of energy-absorbing components that are affixed within or integrally formed with helmets, particularly in the sports field. Techniques have been devised to measure the results of various forces imposed on these helmets and there has been certain advancements in the manufacture of helmets particularly for sports applications. On the other hand, hard hats worn by construction workers have not received the same amount of research and development attention and are rather crude in their design providing only limited protection to the wearer.

The athletic industry is a larger, profitable and more glamorous industry and since children at young ages are also susceptible to injury, advances have been made to protective equipment. However, significant research continues to focus attention on injury to athletes and relatively little attention is given to the injuries of less glamorous construction workers. Most sports helmets have chin straps in addition to sophisticated internal protective components. On the other hand, the unsophisticated construction hard hat does not even use a chin strap and for the most part is constructed only of a single layer of rigid material.

To appreciate the need for secondary helmet underwear and additional energy absorption beneath primary hard hats or helmets it is necessary to understand the how helmets are constructed and tested according to their varying industry protocol standards.

Modern helmets are made from a variety of polymers. Depending on the intended use and the manufacturer, modern hardhat shells may be made of a thermoplastic such as polyethylene or polycarbonate resin, or of other materials like fiberglass, resin-impregnated textiles, or aluminum. Because it is strong, lightweight, easy to mold, and nonconductive to electricity, high-density polyethylene is used in most industrial hard hats. These materials perform differently in terms of impact attenuation in various environments (extreme cold to heat). In general as temperature drops polymers lose elasticity and have a negative effect on energy absorption. The present invention, when worn next to the body, is near the human body temperature and remains supple which enhances its ability to attenuate impact energy.

The National Operating Committee on Standards for Athletic Equipment (NOCSEA) sets standards for testing reconditioned football helmets as well as newly manufactured helmets.

When testing football helmets, NOCSAE standard involves mounting a helmet on an instrumented head model and impacting it a total of 20 times onto a specified impact surface. The testing includes various impact energies, standard and random locations under various environmental conditions. Acceleration measurements are taken to determine if the helmet meets an established Severity Index (SI) requirement. SI is a scientifically accepted measurement of human injury tolerance. Some required impacts are equivalent to running in excess of 12 MPH into a flat surface, which stops a player's head suddenly. Some players run faster than this but seldom if ever experience an impact as violent as the NOCSAE test.

Section 5.2 of the Standard Performance Specification For Recertified Football Helmets (helmets that were in use and are being reconditioned for further use) NOCSAE DOC (ND) 004-00496m06, June 2006, "The peak severity index (SI) of any impact shall not exceed 1200 SI for any helmet manufactured on or after Jan. 1, 1997 and 1500 SI manufactured prior to Jan. 1, 1997.

Previously used football helmets are retested under the NOCSAE 5.2 of the Standard Performance Specification For Recertified Football Helmets NOCSAE DOC (ND) 004-00496m06 June 2006.

NOCSAE requires in section 7.1.2 Specification For Recertified Football Helmets NOCSAE DOC (ND) 004-00496m06, June 2006, that each recertifier (a company that reconditions and tests helmets that were in use) must test an adequate and representative sample size in order to be reasonably sure that helmets returned to use, but not actually tested, may meet the requirements as set out in NOCSAE DOC.001 and NOCSAE DOC 004.

Also as required in NOCSAE section 7.2 Specification For Recertified Football Helmets NOCSAE DOC (ND) 004-00496m06, June 2006, recertifiers are faced with processing a wide range of products in various ages and condition. It is therefore necessary to divide the products submitted for recertification into categories: Good—Repair-Reject.

This NOCSAE standard is an example of the need of the present invention for secondary helmet underwear for proper protection. Human inspection is the only means used in identifying helmets chosen for testing to determine Severity Index in a Drop Test. The chance of a helmet being not being tested, but reconditioned exists. That untested helmet may contain catastrophic defects not visible to the human eye and finds its place in use on the field.

The New York Time, Dec. 12, 2007, Alan Schwartz, Some Used Football Helmets Under Scrutiny; indicated that only 2% of 1.6 million helmets reconditioned are actually drop test procedure.

Under NOCSAE Standard Performance Specification For Newly Manufactured Football Helmets, NOCSAE DOC (ND) 002-98m05 July 2005, sates in section 5.4 "The peak severity index of any impact shall not exceed 1200 SI.

American National Standards for Personal Protection, (ANSI), sets standards for Protective Headware for Industrial Workers for Type I and Type II Hard Hats. ANSI standard ANSI Z89.1-2003, Industrial Protective Helmets, are classified as. Type I Hard Hats—intended to reduce the force of impact resulting from a blow to the top of the head and Type II Hard Hats—designed to provide protection against both side impact and blows to the top of the head. Both types are tested for penetration resistance. There is also electrical shock resistance testing.

Impact Energy attenuation measures a helmet crown's (or top) capability to reduce the force of an impact from falling objects to the top of a wear's head. ANSI Z89.1-2003 testing states: 8 pound steel ball dropped at a free fall height of 5', The force transmitted in transmission testing shall not exceed 4500N (1000 pounds) for any one testing and the average shall not exceed 3780N (850 pounds)

Energy attenuation measures a helmet lateral (side) impact capability to reduce the force of an impact from falling objects to the top and side of a wear's head. ANSI Z89.1-2003 testing states: A helmeted head form (11 pounds) is dropped onto two types of steel anvils, flat, and hemispherical, 1000 maximum peak "G".

The energy absorption properties of the present invention provide impact attenuation and reduce the severity index for both new and reconditioned helmets.

Recent studies have shown that traumatic brain injury (TBI) is (The National Center for Injury Prevention and Control; www.cdc.gov/ncipc/tbi/TBI.htm) defined as a blow or jolt to the head or a penetrating head injury that disrupts the function of the brain. A TBI can result in short or long-term medical problems. Of the 1.4 million who sustain a TBI each year in the United States: 50,000 die; 235,000 are hospitalized; and 1.1 million are treated and released from an emergency department. The number of people with TBI who are not seen in an emergency department or who receive no care is unknown. Direct medical costs and indirect costs such as lost productivity of TBI totaled an estimated $56.3 billion in the United States in 1995.

The Centers for Disease Control and Prevention (The National Center for Injury Prevention and Control; www.cdc.gov/ncipc/tbi/TBI.htm) estimates that at least 5.3 million Americans currently have a long-term or lifelong need for help to perform activities of daily living as a result of a TBI. TBI can cause a wide range of functional changes affecting thinking, sensation, language, and/or emotions. It can also cause epilepsy and increase the risk for conditions such as Alzheimer's disease, Parkinson's disease, and other brain disorders.

A study: "An Examination of Occupational Fatalities Involving Impact-Related Head Injuries in the Construction Industry", published in the Journal of Occupational & Environmental Medicine, April 1998, by Janicak, Christopher Allen PhD (Janicak, Christopher A. (1998). "*An examination of occupational fatalities in the construction industry involving impact-related head injuries.*" *Journal of Occupational and Environmental Medicine,* 40, 1, 347-350.) stated head injuries are the reason for which workers' compensation claims are most frequently filed and have the highest average cost per claim. The purpose of the study was to identify the construction industry trades with the greatest risk for an occupational fatality due to impact-related head injuries. Proportionate mortality ratios identified the highway and streets construction trades as having over three times the expected number of fatalities due to impact-related head injuries than expected, while the heavy construction trades had over two times the expected number of fatalities due to impact-related head injuries. The majority of these fatalities are the result of vehicle incidents and the worker's being struck by various forms of equipment that were in the process of being moved.

In 1995, the Bureau of Labor Statistics (BLS) identified the head as being the major source of injury in approximately 24% of all occupational fatalities. Other statistics dramatically tell the story of head injury in the United States. Each year approximately:

1.4 million people experience a TBI
50,000 people die from head injury
1 million head-injured people are treated in hospital emergency departments
230,000 people are hospitalized for TBI and survive

OBJECTS OF THE INVENTION

Accordingly, it is an object of the present invention to provide an energy absorbing secondary helmet underwear that is fashionable and yet functionally absorbs energy and reduces injury when worn beneath a primary rigid hat structure such as a helmet or hard hat.

Another object of the present invention is to provide an energy absorbing helmet underwear that uses a cushioning core of a compressable material supported between fabric layers.

Still another object of the present invention is to provide an energy absorbing helmet underwear structure that is preferably provided as a one piece semi-spherical dome shape worn by the user and constructed and arranged so as to enable a rigid hat structure to be worn thereover.

Still another object of the present invention is to provide an improved energy absorbing helmet underwear in which inner and outer fabric shells have an elasticized circumferential band and in which the helmet underwear is thus able to be readily fitted and secured to the user's head.

Still another object of the present invention is to utilize warp knit and/or circular knit three dimensional spacer fabrics in an energy absorbing composite assembly.

Still another object of the present invention is to utilize circular knit fabrics.

Still another object of the present invention is to incorporate fabrics with antimicrobial Antibacterial properties.

Still another object of the present invention is to optimize the vapor transportation characteristics of the open three dimensional spacer knits which allow the fabrics to breathe and transport moisture away from the perspiring body therefore there will be less retained moisture to cause infection or host foreign bacteria Still another object of the present invention is to utilize the inherent warp and circular knit fabric's properties of elasticity whereby the one piece assembly—spherical dome shape is self-elasticized thereby negating the need for an elasticized sweatband. Elasticizes head bands are optional in the present invention.

Still another object of the present invention is to improve the primary helmet's management of externally applied impact test forces.

Still another object of the present invention is to improve the severity index for both new and reconditioned helmets.

SUMMARY OF THE INVENTION

To satisfy the forgoing and other objects, features and advantages of the present invention, there is provided a fashionable helmet underwear which, when worn beneath the primary means of protection such as a helmet, offers additional energy absorption thus contributing to the protection of the user's head. In accordance with the present invention there is provided a one piece hemispherical, composite assembly consisting of a compressable 3 dimensional warp knit or viscoelastic cushioning core that is disposed between inner and outer self elasticized 3 dimensional spacer system circular knit fabric shell members which may be additionally provided with an optional circumferential elasticized headband. The secondary energy absorbing helmet underwear is configured to offer additional cushioning protection beyond that provided by the primary hat structure while preferably being breathable and waterproof.

In accordance with one aspect of the present invention there is provided a shock absorbing helmet underwear structure that is adapted to be worn by a user primarily under a rigid hat structure such as a hard hat or helmet. In one embodiment the helmet underwear may comprise a structural 3 dimensional circular knit spacer system fabric that is provided in separate fabric layers that define therebetween a pocket for receiving a 3 dimensional spacer system warp knit or viscoelastic energy absorbing insert layer that is adapted to be disposed in the pocket. In a preferred embodiment described herein the energy absorbing warp knit or viscoelastic core can be externally exposed to view as energy absorbing plaques attached to the self elasticized inner 3 dimensional circular knit spacer system shell. An optional stretch band is attached to the fabric layers to enable the helmet underwear to be fitted over the user's head while the energy absorbing insert provides a safety barrier between the rigid hat structure and the user's head.

In accordance with a preferred embodiment of the present invention there is provided an energy absorbing helmet underwear that is adapted to be worn by a user under a rigid hard hat, sports helmet or military helmet. The helmet underwear comprises an integral stretchable and flexible material that includes a self elasticized three-dimensional structure that is generally of semi-spherical shape to fit about the user's head and that includes an optional peripheral stretchable stretch band that provides a means for retaining the helmet underwear in place on the users head. In a preferred embodiment the inner and outer shell stretchable material includes 3 dimensional circular knit spacer fabric as the front and rear layers that are each formed as a knitted layer and interconnecting yarns that interconnect between the front and rear layers and define a predetermined spacing between the front and rear layers. The circular knitting, a type of weft knitting, utilizes a revolving cylinder and or dial carrying one or more yarns to create loops across the width of the fabric, knit in tubular form to a customary thickness of 15 mm. If more than 15 mm of thickness is required to provide the desired energy absorption a energy absorbing 3 dimensional warp knit core is attached to the inner circular knit shell. The warp knit core is constructed whereby each needle loops its own thread, and yarns run lengthwise in the fabric forming interlocking loops. The warp knit energy absorbing core can be as much as 50 mm. 3 dimensional knit spacer fabrics knit as many as 3 fibers in a single structure, maximizing breathability, vapor transportation, impact resistance, recovery and durability. The interconnecting yarns, in combination with the composite layers provide a safety barrier between the rigid hat and the user's head.

DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 1:
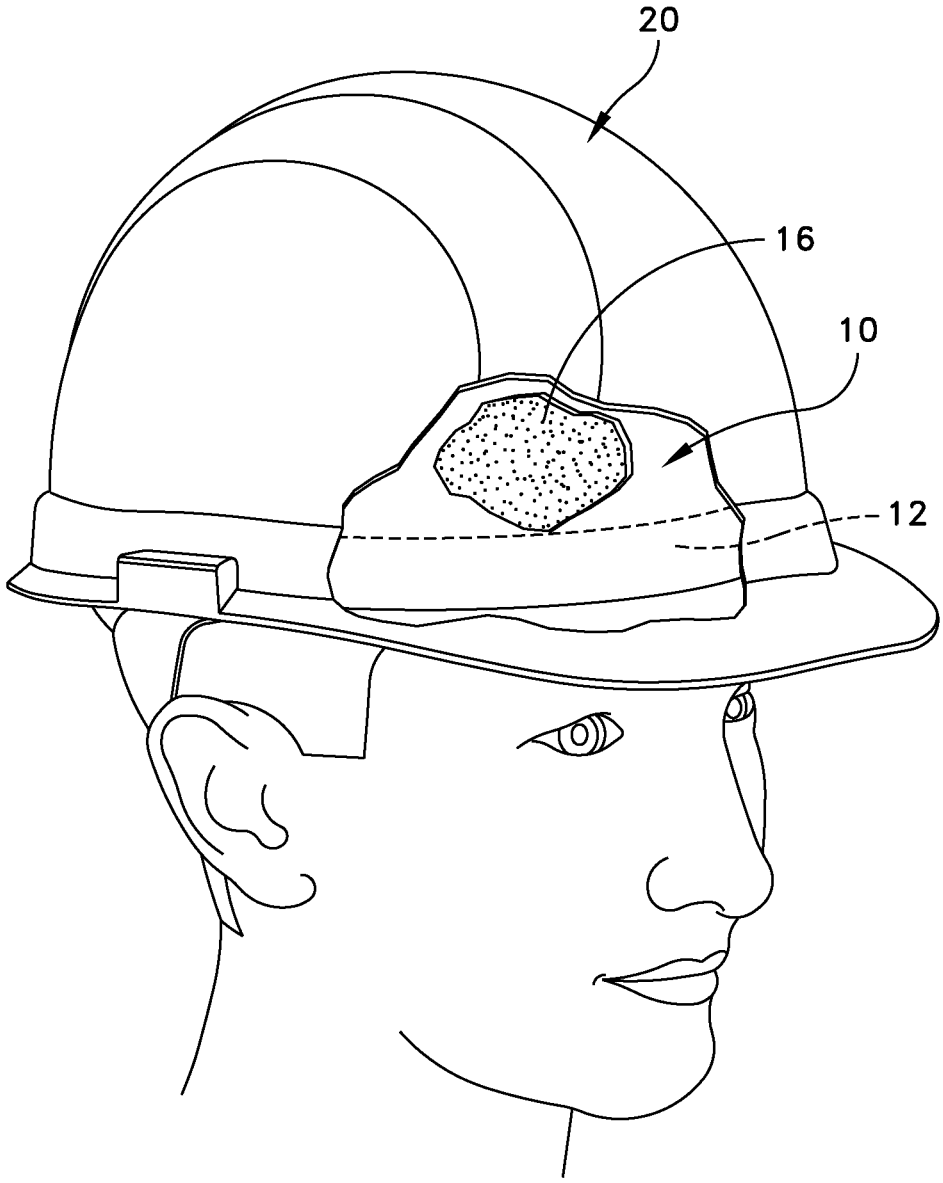
FIG. 1 is a perspective view that is partially cut away to show the energy absorbing helmet underwear of the present invention as worn under a rigid hat structure such as the depicted hard hat.
Figure 2:
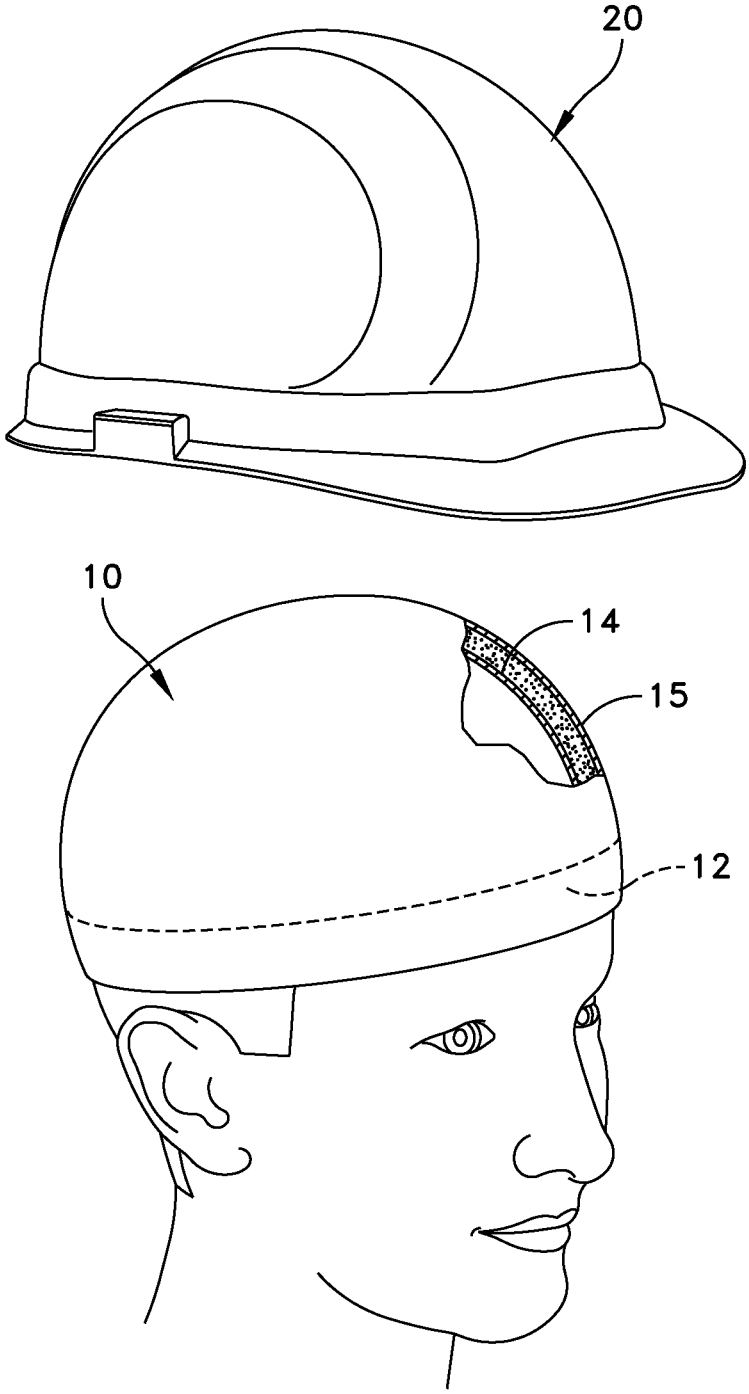
FIG. 2 is an exploded perspective view showing the helmet underwear of the present invention and associated hard hat.
Figure 3:
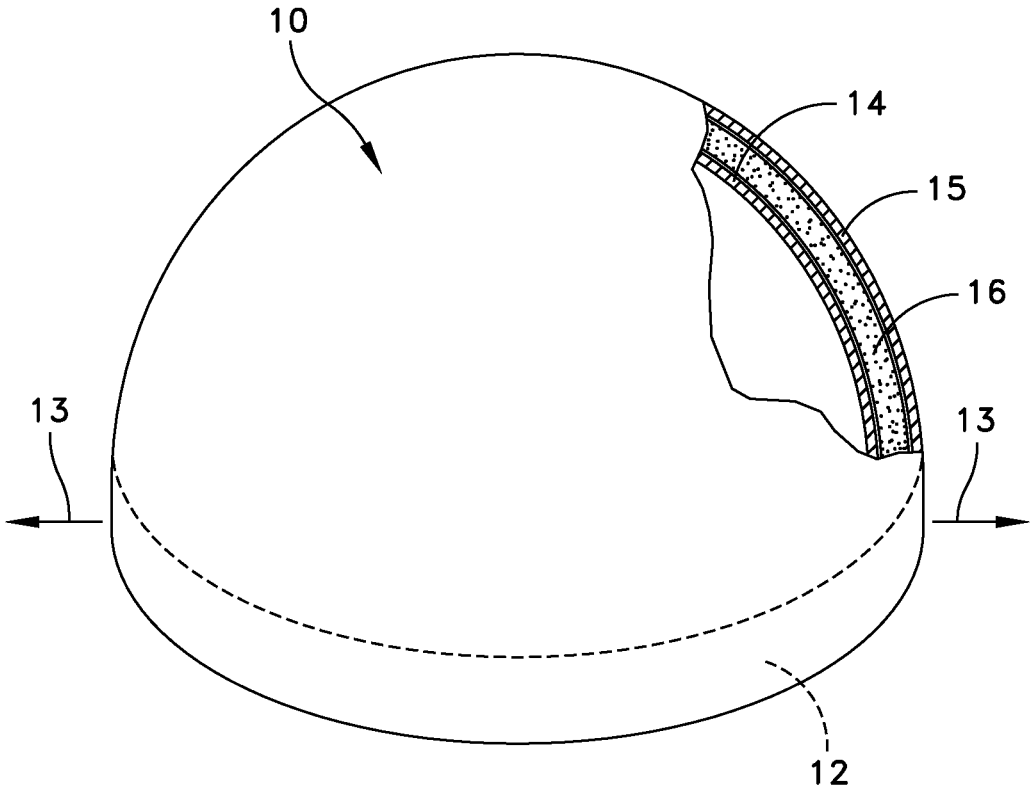
FIG. 3 is a perspective view of the energy absorbing helmet underwear of the present invention with the structure partially cut away.
Figure 9:
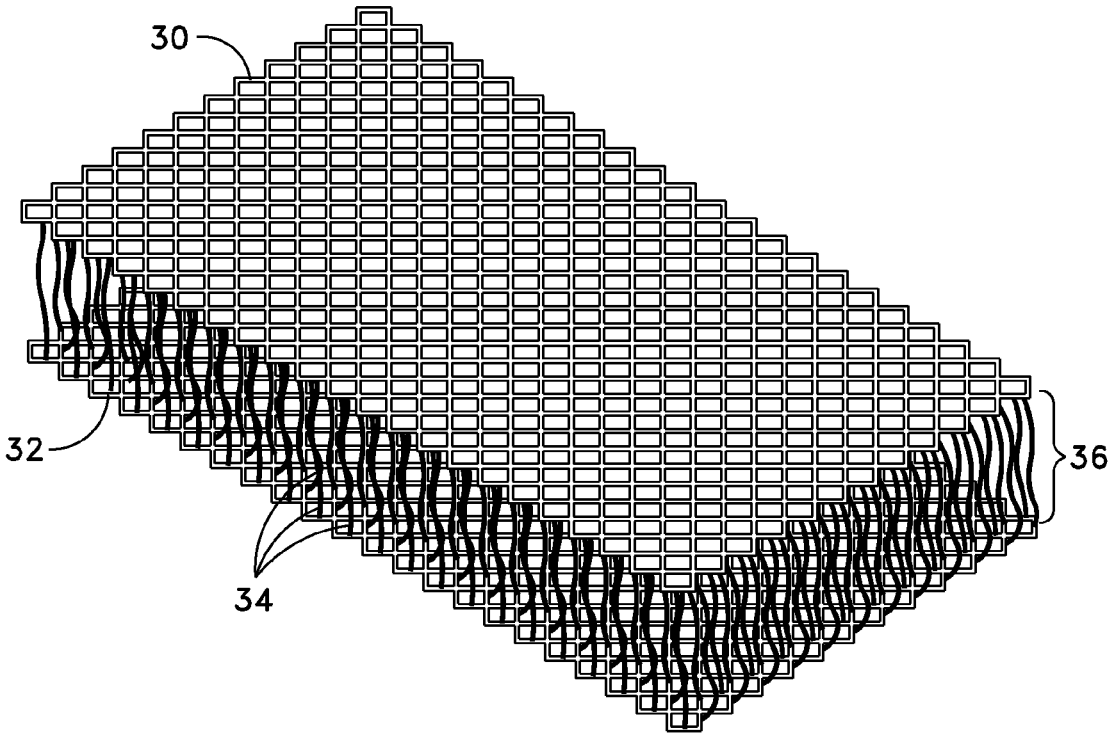
FIG. 9 is a fragmentary view of a preferred embodiment of the material that comprises the compressible core/shell construction.

Reference is now made to the drawings for different embodiments of the energy absorbing helmet underwear of the present invention. The helmet underwear 10 is shown in FIGS. 1 and 2 as stretched about the head of the user. For this purpose, the self elasticized helmet underwear 10 is provided with an optional peripheral headband portion 12. The headband portion 12 is stretchable to at least a small amount, such as in the direction of arrows 13 depicted in FIG. 3. The headband portion 12 may be stretched so that the energy absorbing helmet underwear may be fitted over the user's head. In the illustration of FIG. 2 the energy absorbing helmet underwear 10 is shown having been stretched and pulled over the user's head to the position where the headband portion 12 maintains the energy absorbing helmet underwear in position. The preferred embodiment of the helmet underwear is shown in FIG. 9 in which the shell and core are integrally formed.

Even when a headband part is not used the material itself of the underwear is constructed to be stretchable so that when the user puts the underwear on it stretches over the head and stays in position by virtue of the stretchable nature of the underwear material. It not only stretches but also provides a firm hold on the head of the user. The underwear is separate from the helmet itself and is not attached to the helmet. It can thus be stretched over the head before the helmet is put on the head. The underwear provides the additional absorption protection while providing a decorative piece of head underwear when the helmet is not worn.

Figure 1A:
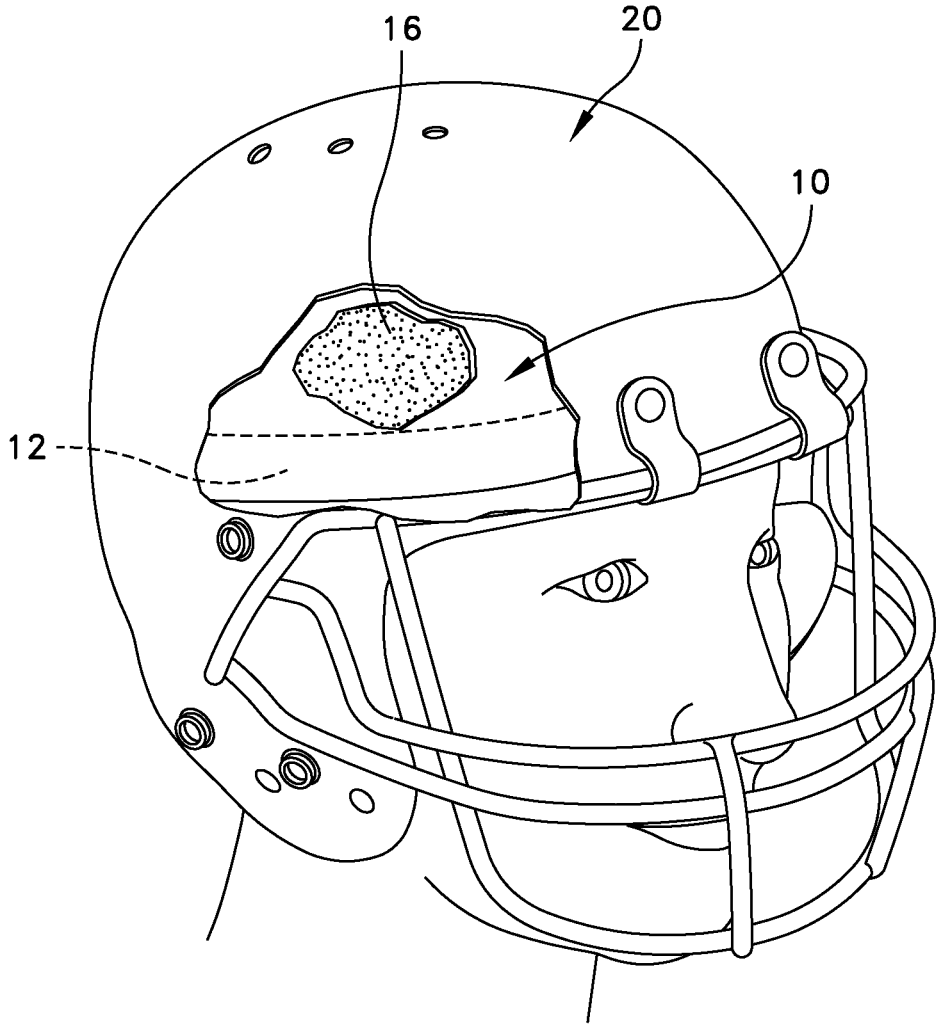
FIG. 1A is a perspective view that is partially cut away to show the energy absorbing helmet underwear of the present invention as worn under a rigid hat structure such as the depicted sports helmet.
Figure 1B:
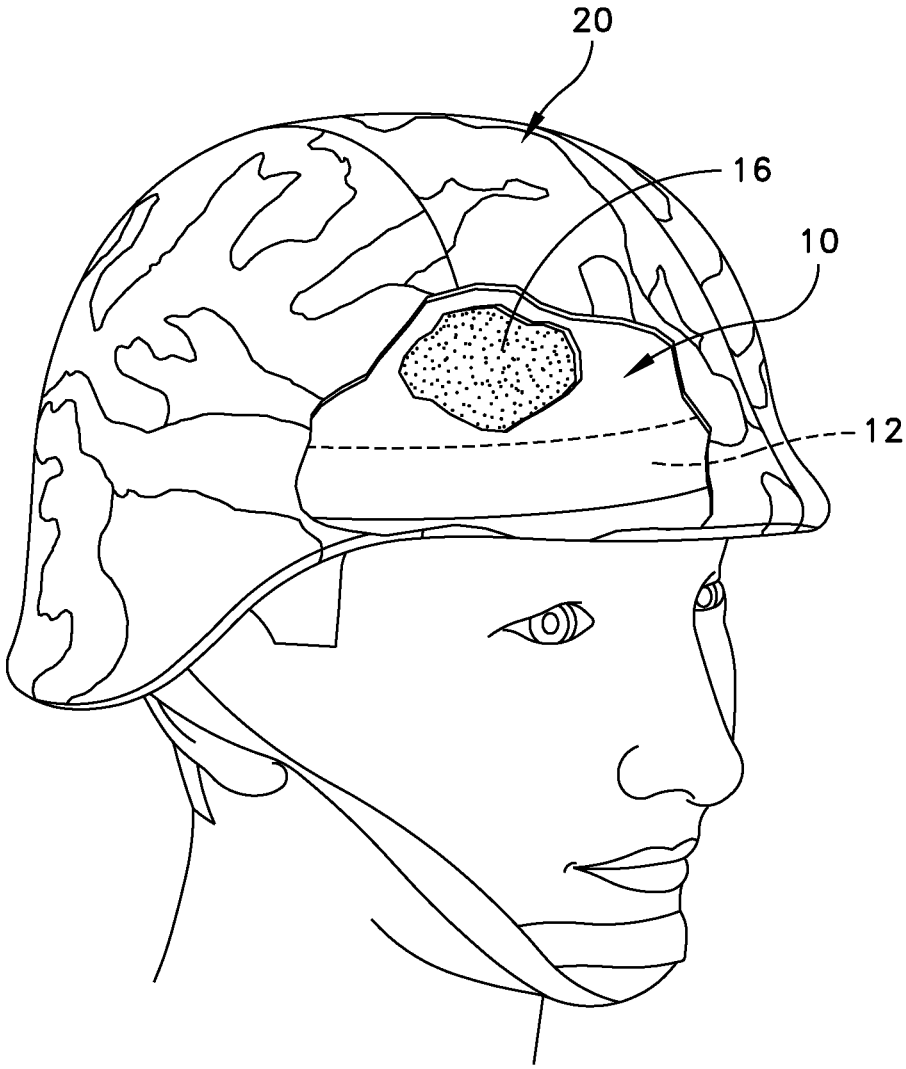
FIG. 1B is a perspective view that is partially cut away to show the energy absorbing helmet underwear of the present invention as worn under a rigid hat structure such as the depicted military helmet.

FIGS. 1 and 2 also illustrate a hard hat 20. The helmet underwear of the present invention is meant to be used under a rigid hard hat such as that illustrated in FIGS. 1 and 2. Alternatively, the energy absorbing helmet underwear of the present invention may be used under other types of rigid hats or helmets such as under a sports helmet or military helmet. Refer to the sports helmet shown in FIG. 1A and the military helmet shown in FIG. 1B. The same reference numbers are used in FIGS. 1A and 1B as described in FIG. 1.

Figure 4:
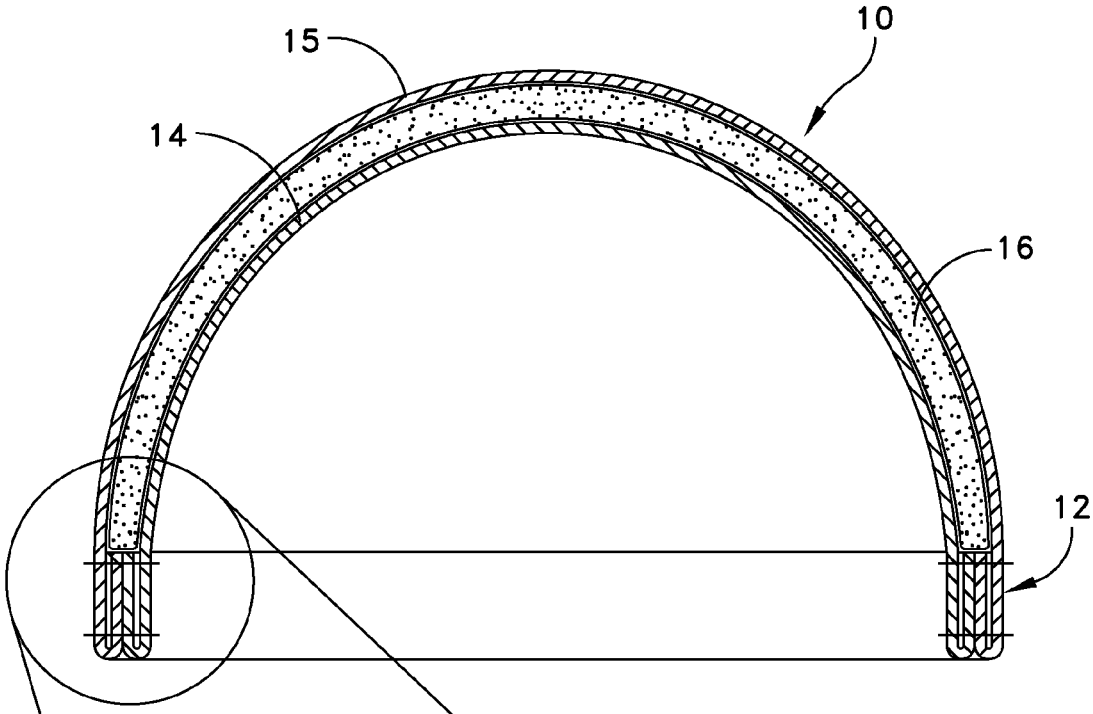
FIG. 4 is a cross-sectional view through the helmet underwear structure of FIG. 3.
Figure 5:
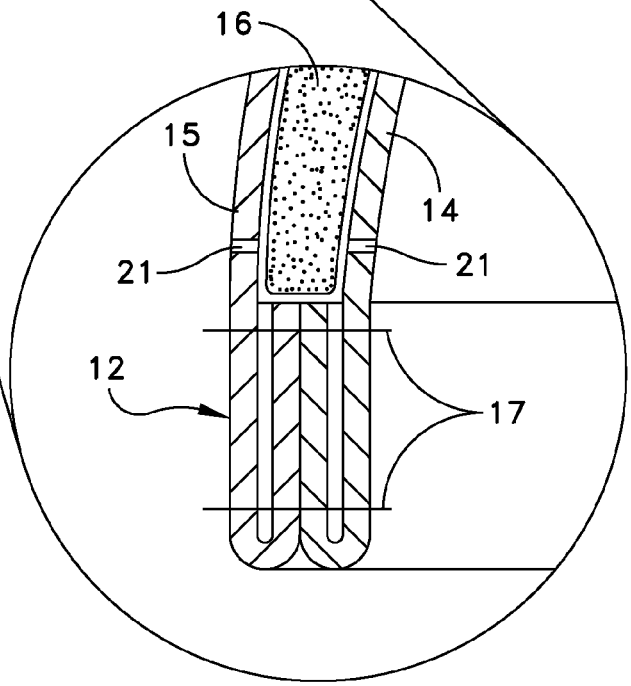
FIG. 5 is an enlarged fragmentary view of the helmet underwear of the present invention where the headband attaches to the fabric layers.
Figure 6:
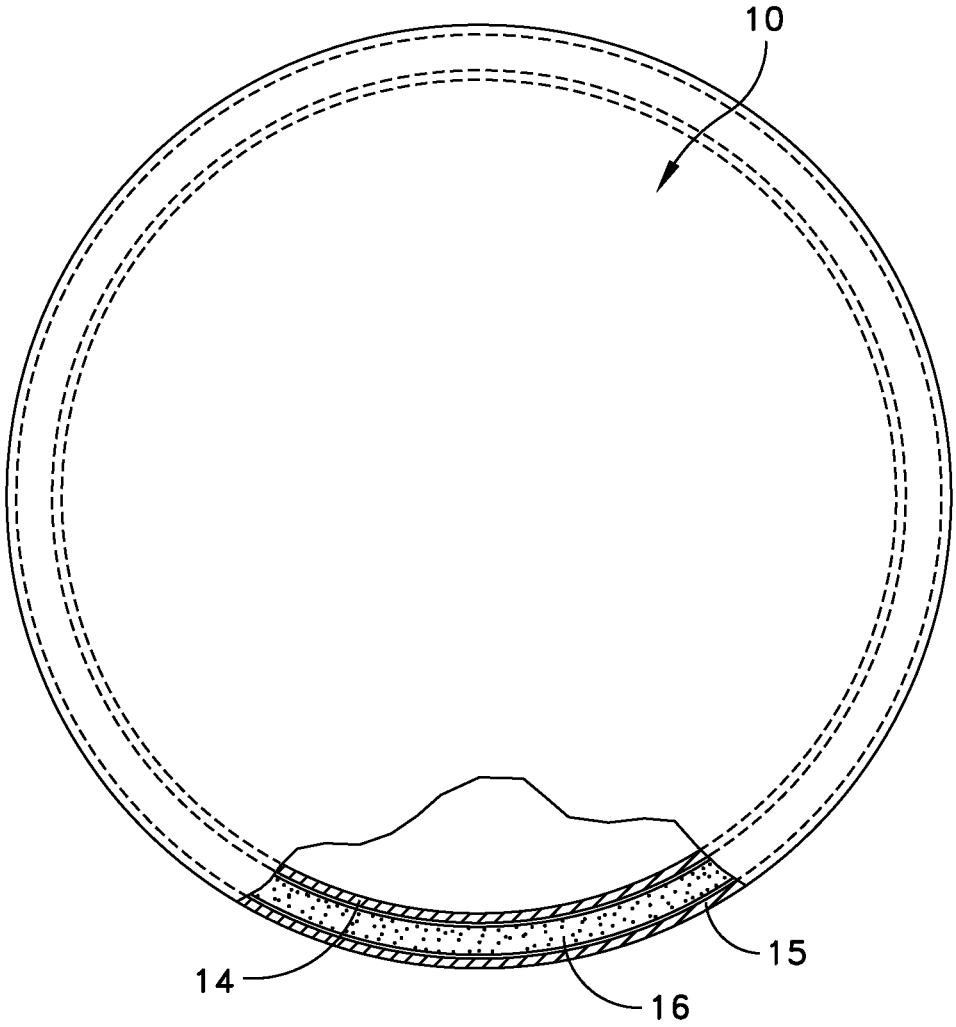
FIG. 6 is a plan view of the helmet underwear structure of the present invention with a portion partially cut away.
Figure 7:
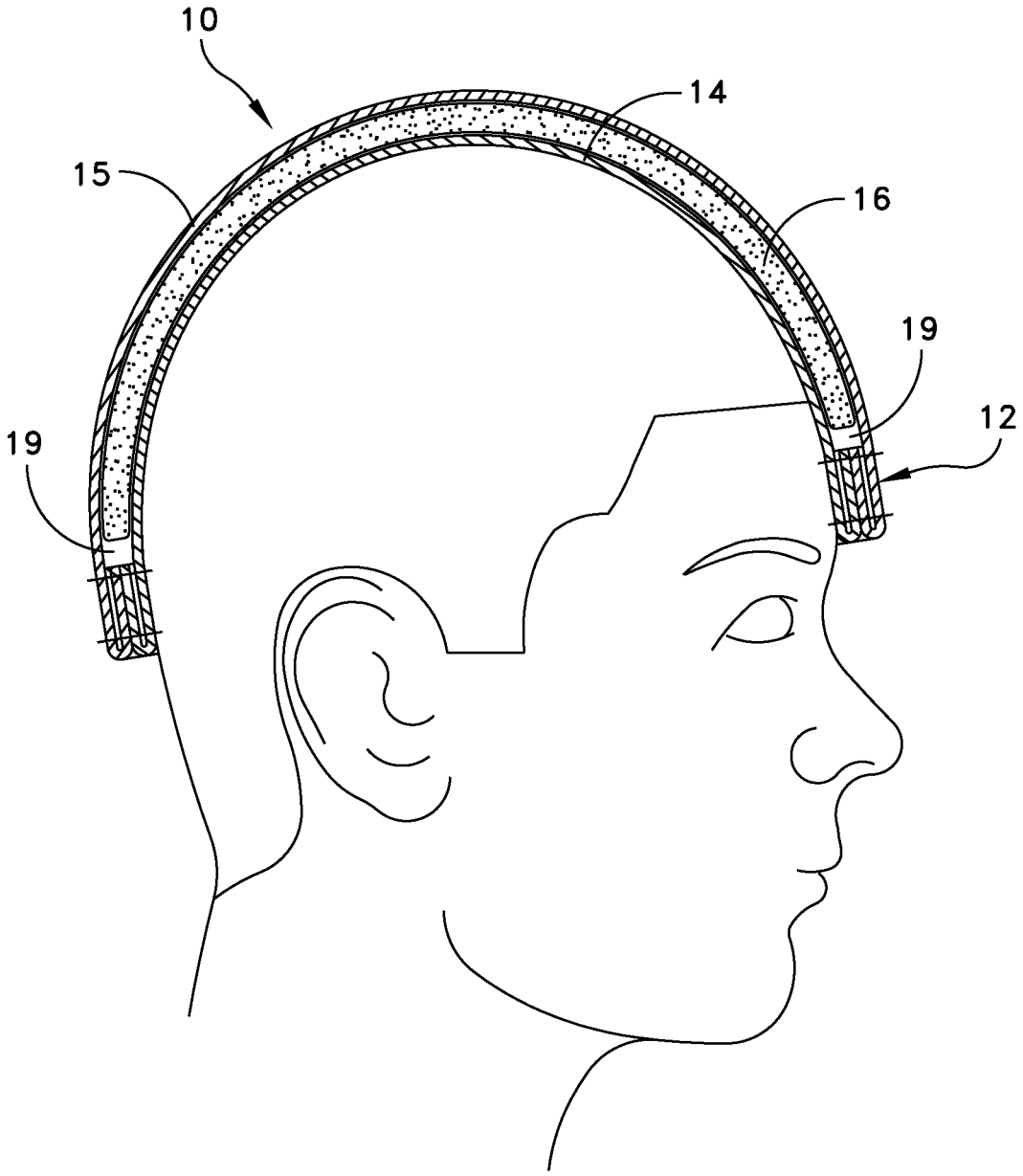
FIG. 7 illustrates a cross-section through the helmet underwear of the present invention as positioned on the user's head.
Figure 8:
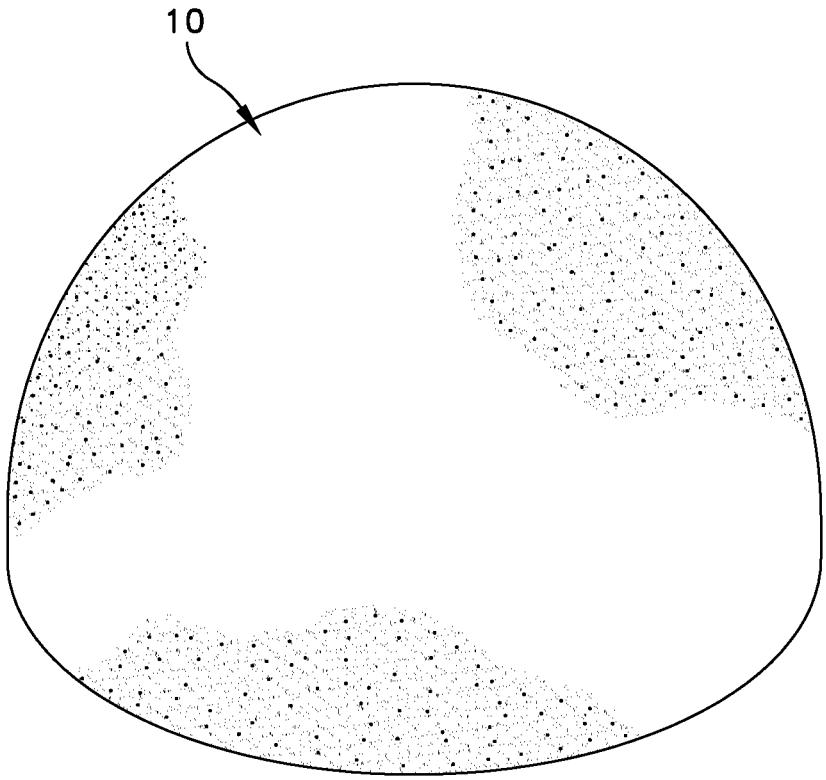
FIG. 8 is a perspective view of the energy absorbing helmet underwear of the present invention.

The energy absorbing helmet underwear 10 is comprised of a stretchable fabric material and is illustrated in the drawings as including separate fabric layers 14 and 15 that together form an open pocket for receiving the energy absorbing core layer 16. In this regard refer to FIGS. 4-7 which include cross-sections illustrating the helmet underwear 10 and its fabric layers 14 and 15 and core 16. It is noted that the layer or shell 14 is an inner member while the outer member is the layer or shell 15. The cross-sectional views of FIGS. 4 and 5 also show the headband portion 12 which may be a separate headband or just an integral extension of the layers 14 and 15 as illustrated in FIGS. 4 and 5. Some form of stitching as illustrated at 17 in FIG. 5 may be used through the headband. If the headband material is made of a different material then that material would tend to be more expandable than the material of the layers 14 and 15. The layers or shells 14 and 15 may be constructed of a high performance monofilament, polyester, recycled, reprieve, nylon or other stretchable material. In still a further embodiment of the present invention the shells 14 and 15 may be constructed of a knitted elastic and stretchable micro fiber material such as that disclosed in any one of U.S. Pat. No. 4,929,492; 5,238,733; 4,992,327 or 5,316,837 all of which are hereby incorporated by reference in their entirety.

The cross-sectional views of FIGS. 4 and 5 illustrate the core layer 16 which is an energy absorbing layer. This layer generally does not have as great an elasticity as the shell layers 14 and 15. The energy absorbing layer 16 is disposed in a pocket defined between the layers 14 and 15 and is preferably free-floating, meaning that there is preferably no stitching through the layers 14 and 15 and through the core material 16. When the helmet underwear 10 is not applied to the head, the core layer substantially fills the entire pocket between the layers 14 and 15. On the other hand, when the helmet underwear 10 is applied to the head as in the illustrated cross-sectional view of FIG. 7, then the layers 14 and 15 stretch relative to the core material 16 leaving slight gaps 19 on either end of the material 16. The core material may be a flexible and compressible a 3 dimensional warp knit spacer fabric or elastomeric material such as polyurethane. In this regard, material such as disclosed in U.S. Pat. No. 4,777,739 may be used as a core material. U.S. Pat. No. 4,777,739 is hereby incorporated by reference in its entirety. The core material preferably has a thickness on the order of ⅛ inch to ¼ inch.

Reference is now made to FIG. 9 for a diagram of a preferred embodiment of the present invention in which the core and shells are integrally formed. In this regards reference has been made before to U.S. Pat. No. 6,103,641 which one skilled in the art would normally use as a fabric for blunt trauma reduction in body armor. This material has now been found as useable in forming the compressible helmet underwear of the present invention. It would not have been anticipated by one skilled in the art that a material for body armor would be useable in helmet underwear, as generally speaking, armor is not useable for the head. However, it was surprisingly found that the combination of the fabric layers with the interconnecting filament yarns provides a flexible and compressible material that is well suited for use in helmet underwear. This enables the helmet underwear to be worn as a fashionable piece of helmet underwear while at the same time providing enhanced shock absorption, particularly under a helmet or rigid hat structure.

In FIG. 9 the material is shown as comprised of layers 30 and 32 interconnected by the filament yarns 34. The fabric may be made using a warp knit such as on a two needle bar specialty Raschel machine, or on a weft knit circular machine of the rib or interlock type. The yarns 34 are preferably monofilament yarns and may be of the bi component or multi component fiber type having a fineness of 70-200 denier. Refer to other particulars of the components 30, 32 and 34 to the '641 patent. The layer 30 may be considered as a front layer or front face and the layer 32 may be considered as a rear layer or rear face. The back face is attached to the front face by a system of interconnecting yarns 34 that fill the interval or distance between the faces as indicated by the reference number 36 in FIG. 9. This distance 36 may be from 12 to 30 millimeters depending upon the particular product requirements. It is noted that this arrangement also permits free air circulation.

The yarns 34 are preferably monofilament yarns in order to increase resilience and may be either bi-component or multi-component fibers. These yarns may have a fineness in the range of 70-200 denier. The density of the yarns or threads is in threads per square inch. This density may range from 1,000 to 3,000 threads per square inch. The interconnecting yarns may also have a substantial stiffness in a range of 30-90 based upon the industrially known Shore A scale. The interconnecting yarns are selected from high performance yarns, having a tenacity of at least 15 grams/denier.

The construction of the layers 30 and 32 is preferably of an open or mesh form that is porous so as to provide optimum air circulation. The yarns of the layers 30 and 32 may be polyester yarns.

The material illustrated in FIG. 9 has the following characteristics. There is inherent softness and draping when using a circular knit. The space between the layers provides excellent air permeability. Warp knitting may also be used for the layers. The construction illustrated in FIG. 9 provides a breathable structure that may be constructed relatively thin and is light in weight. The structure preferably has anti-microbial properties is moldable, durable, washable, colorfast and ecologically friendly. The face of the material, because of its textile nature, is compatible with the skin and more compatible than such other materials as foams or plastic materials. This material, as a textile product, is easy to clean through washing or other means than materials such as foam or a honeycomb. The knit characteristic of the layers makes the product conform readily to the body contours particularly at the head. The "pushing" effect provided by this integral material does not diminish with age or use.

As indicated previously there are various knit patterns that may be used with the front and rear layers. A circular knit is preferred to be used in conjunction with a sports helmet while a warp knit with heavier yarn is preferred as more suitable for use under a hard hat or military helmet. A warp knit PPS fabric such as the Gehring SHRB 32 (FR) fire resistant model filament polyester may be used in military helmet applications. The outer shell may be of nylon microdenier spandex.

Figure 10:
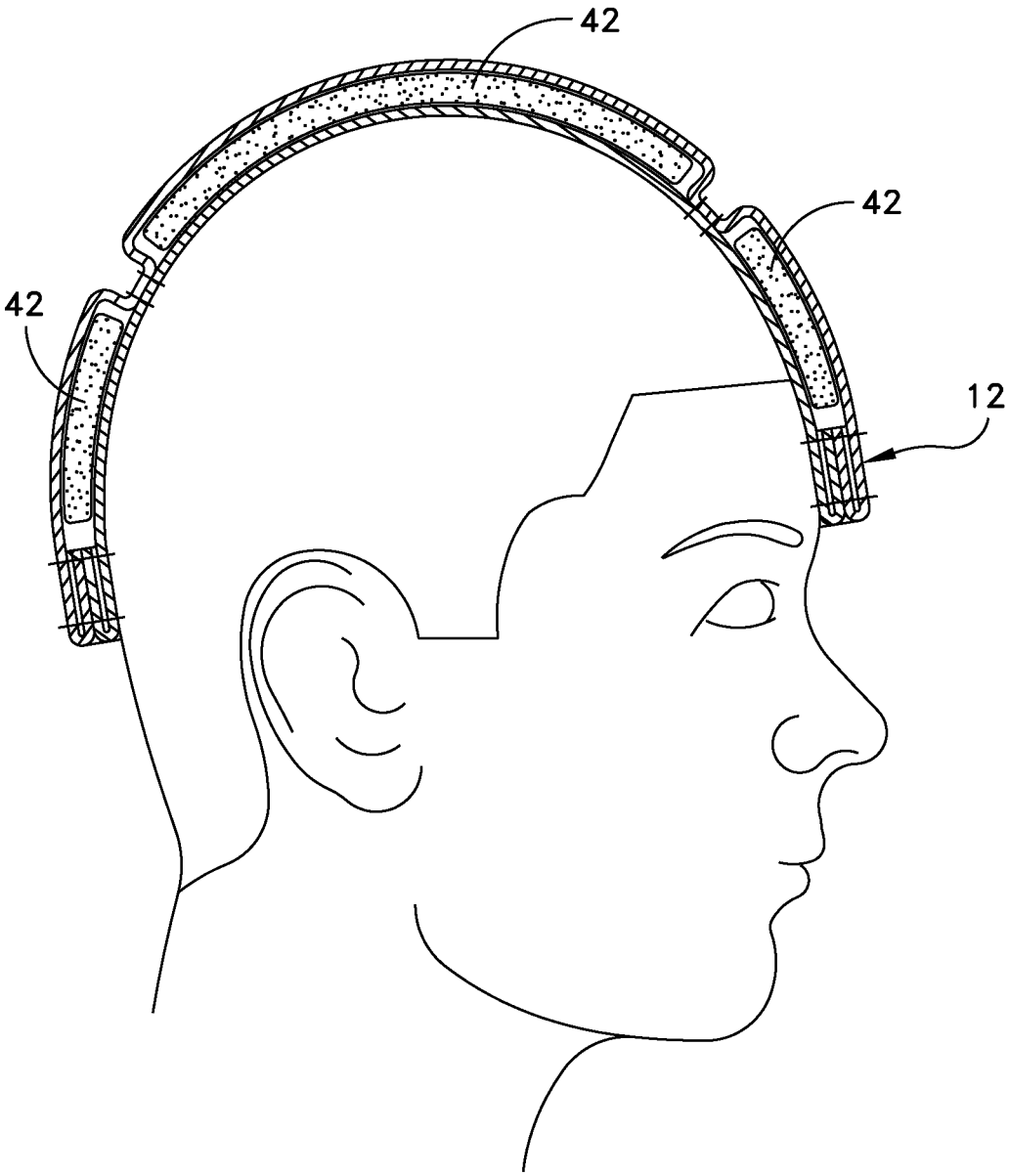
FIG. 10 illustrates another embodiment of a cross-section through the helmet underwear as positioned on the user's head.
Figure 11:
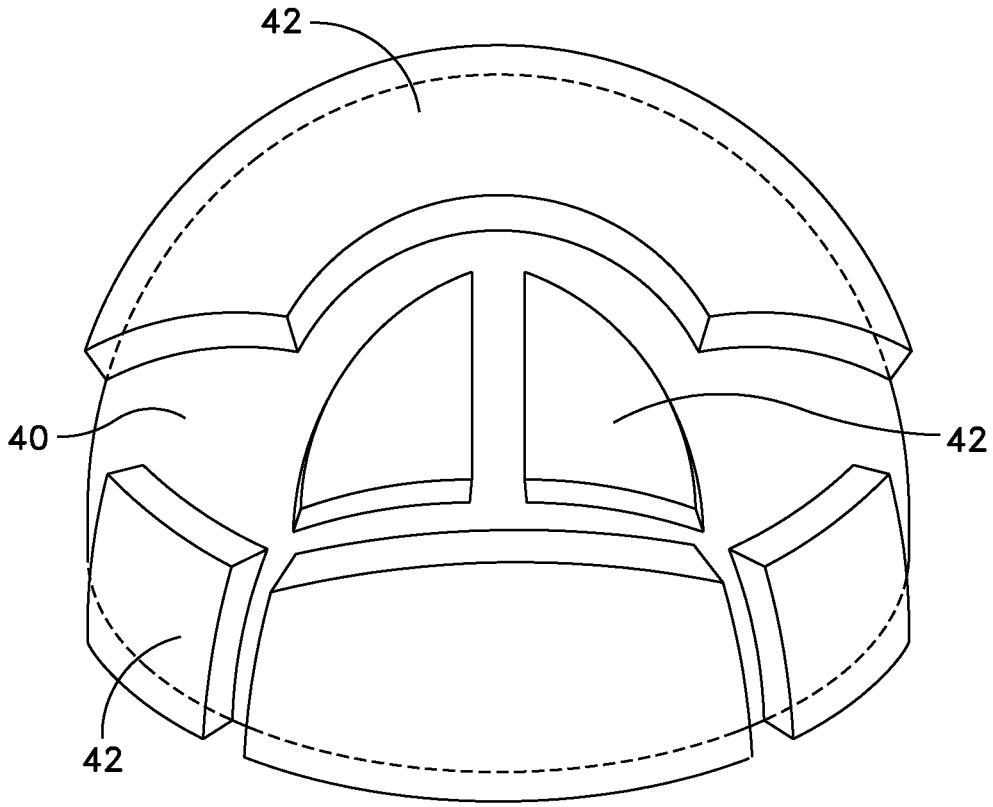
FIG. 11 is a perspective view of the embodiment shown in FIG. 10.

Reference is now made to FIGS. 10 and 11 for an alternate piece of headwear. In FIG. 10 the same reference numbers are used to identify similar components shown previously in FIG. 7. This includes self-elastic layers 14 and 15 that may be constructed of a circular knit 3 dimensional spacer system forming inner and outer shells. The core is of an ergonomically placed warp knit 3 dimensional spacer system that forms the inner core. Refer also to the perspective view of FIG. 11 illustrating the inner layer at 40 and the ergonomically placed warp knit segments at 42. The segments 42 may be adhesively attached between the inner and outer shells.

Figure 12:
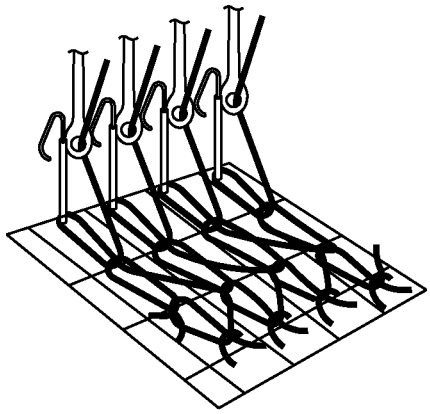
FIG. 12 illustrates a warp knit.

In warp knitting each needle loops its own thread and yarns run lengthwise in the fabric, forming interlocking loops. Refer to FIG. 12 for an illustration of a warp knit. Raschal warp knitting can knit practically any fiber and any denier combining fibers to maximize specific qualities depending on the desired level of energy absorption. The spacer fabric is in fact two fabrics produced together on a double bed Raschal machine and connected either by mono filament or other yarns. Fabrics can have an ultimate thickness of 1.5-10 mm however can be produced up to 60 mm depending upon the desired level of energy absorption. Warp knit fabrics can be produced with higher or lower pile or connecting thread density relative to fabric area also a small or large spacer. This gives varying degrees of crush resistance, an important characteristic for certain end uses.

Another advantage of three dimensional warp and circular knit fabrics is that they are elastic in three dimensions and are not omni-directional as with neoprene or other visco-elastic foams. Another advantage of three dimensional warp and circular knit spacer fabrics is their impact resistance, compression and deflection does not depend only upon thickness.

When the protective helmet underwear of the present invention is used under a sports helmet such as a football helmet it is preferred to use a circular knit core which is relatively thin and compressable with good moisture and anti-microbial qualities. For use under a hard hat a warp knit is preferred with heavier yarn which is more suitable. Also the spacing between layers may be thin and compressable with good moisture transportation and anti-microbial qualities. For military applications a warp knit is preferred with heavier yarn which is more suited for use with military helmets.

Figure 13:
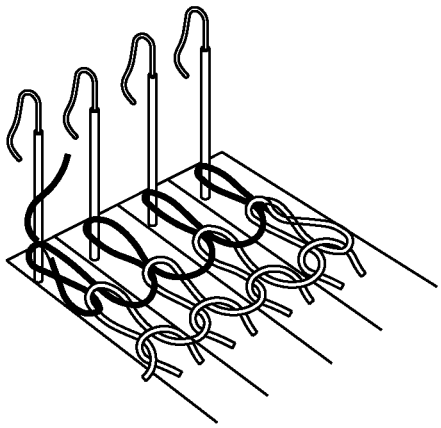
FIG. 13 illustrates a circular knit.

Circular knitting is a type of weft knitting which utilizes a revolving cylinder or dial carrying one or more loops across the width of the fabric, knit in tubular form. Refer to FIG. 13 for an illustration of a circular knit. Single and double knit machines range in size from 12-42 gauges, offering a diverse array of fabrics and resulting in various degrees of energy absorption depending upon the ultimate use. Weft knitted three dimensional circular knit spacer fabrics are limited to approximately 15 mm in thickness. They have inherent softness and good draping with pleasant tactile comfort when in contact with a human body.

The present invention optimizes the vapor transportation characteristics of the open three dimensional spacer knits which allow the fabrics to breathe and transport moisture away from the perspiring body and therefore there is less retained moisture to cause infection or host foreign bacteria. The space provided by the connecting or pile yarns provides excellent air permeability. The composite assemblies are capable of transporting both cool air to the body and transporting perspiration away from the body.

The present invention improves the primary helmet's management of externally applied impact test forces. Impact attenuation is an acceleration measurement taken to determine if the helmet meets an established severity index, which is a scientifically accepted measurement of human injury tolerance. It is possible that slight variation in the helmet test impact can cause a difference in the helmet response. It is also possible that material differences, density, lay up or manufacturing assembly methods may produce a difference in response. If the test energy applied is within the helmet's ability to respond, the test results may be within a reasonable criteria. If the energy is beyond the helmet's ability to respond, then the peak shock may dramatically increase to levels beyond any reasonable criterion causing defamation not just to the helmet but in the test head form which represents the users head. The present invention assists the primary helmet's management of the applied impact energy.

Having now described a limited number of embodiments of the present invention, it should now be apparent to those skilled in the art that numerous other embodiments and modifications thereof are contemplated as falling under the scope of the present invention, as defined by the appended claims.

What is claimed is:

1. Energy absorbing helmet underwear that is adapted to be worn by a user under a rigid hard hat or the like and comprising:

a pair stretchable fabric shells;

a shock absorbing core material that is disposed between said shells; and a stretch band attached to the fabric shells to enable the headpiece to be fitted over the user's head while the shock absorbing core material provides a safety barrier between the rigid hat and the user's head;

wherein the shock absorbing core material comprises an energy absorbing core layer that is a three-dimensional warp knit spacer fabric;

wherein the stretchable fabric layers have a greater elasticity that the energy absorbing core layer;

wherein the energy absorbing core layer is disposed in a pocket defined between the stretchable fabric layers and is free-floating therein without any fastening means between the stretchable fabric layers and the energy absorbing core layer;

wherein, when the energy absorbing underwear is off the head of the user, the energy absorbing core layer substantially fills the entire pocket between the stretchable fabric layers;

wherein, when the energy absorbing underwear is applied to the head of the user, then the stretchable fabric layers stretch relative to the energy absorbing core layer leaving a slight gap on either end of the energy absorbing core layer; and wherein the stretch band is a continuous annular-shaped band that is adapted to fit about the head of the user.

2. The helmet underwear of claim 1 including stitching through the stretch band.

* * * * *